US011060421B2

(12) United States Patent
Magee et al.

(10) Patent No.: US 11,060,421 B2
(45) Date of Patent: Jul. 13, 2021

(54) SYSTEM TO AGGREGATE WORKING FLUID FOR HEAT RECOVERY STEAM GENERATORS

(71) Applicant: General Electric Company, Schenectady, NY (US)

(72) Inventors: Jeffrey Frederick Magee, Longmeadow, MA (US); Van Dang, Bloomfield, CT (US); Denis Robert Bruno, Amherst, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/662,251

(22) Filed: Oct. 24, 2019

(65) Prior Publication Data

US 2020/0056510 A1 Feb. 20, 2020

Related U.S. Application Data

(63) Continuation-in-part of application No. 15/830,525, filed on Dec. 4, 2017, now Pat. No. 10,472,993.

(51) Int. Cl.

| | |
|---|---|
| ***F01K 11/02*** | (2006.01) |
| ***F28F 9/02*** | (2006.01) |
| ***F01K 7/38*** | (2006.01) |

(52) U.S. Cl.

CPC ..... *F01K 11/02* (2013.01); *F01K 7/38* (2013.01); *F28F 9/0246* (2013.01)

(58) Field of Classification Search

CPC ..... F01K 11/02; F01K 7/38; F01K 23/101; F28F 9/0246; F28D 1/0408

See application file for complete search history.

(56) References Cited

U.S. PATENT DOCUMENTS

| | | | | |
|---|---|---|---|---|
| 3,101,930 | A | 8/1963 | Huet | |
| 3,835,920 | A | 9/1974 | Mondt | |
| 3,866,674 | A | 2/1975 | Tramuta et al. | |
| 4,196,700 | A | 4/1980 | Keseru et al. | |
| 4,254,826 | A | 3/1981 | Adams | |
| 6,957,630 | B1 | 10/2005 | Mastronarde | |
| 7,770,544 | B2 * | 8/2010 | Viskup, Jr. ..... | F22B 21/002 122/235.19 |
| 7,963,097 | B2 * | 6/2011 | Mastronarde ..... | F28D 7/1623 60/39.511 |

(Continued)

OTHER PUBLICATIONS

U.S. Appl. No. 15/830,525, Notice of Allowance dated Jul. 8, 2019, 10 pgs.

*Primary Examiner* — Shafiq Mian
(74) *Attorney, Agent, or Firm* — Hoffman Warnick LLC

(57) ABSTRACT

A system for aggregating a working fluid includes a fluid delivery line defining a fluid connection to at least one downstream process component; a plurality of collection lines each fluidically connected to a plurality of header lines by a respective set of header links; and a connecting junction fluidically connecting each of the plurality of collection lines to the fluid delivery line, the connecting junction including: at least one tee member oriented substantially perpendicularly with respect to the fluid delivery line, the at least one tee member connected to the fluid delivery line, and a plurality of branch fluid lines each fluidically coupling a respective one of the plurality of collection lines to the at least one tee member.

17 Claims, 4 Drawing Sheets

(56) References Cited

U.S. PATENT DOCUMENTS

| | | | | |
|---|---|---|---|---|
| 2006/0144348 | A1* | 7/2006 | Viskup, Jr. | F22B 1/1815 122/235.15 |
| 2007/0101717 | A1 | 5/2007 | Beaulieu | |
| 2007/0266962 | A1* | 11/2007 | Stone | F22B 21/002 122/7 R |
| 2009/0050079 | A1* | 2/2009 | Krowech | F22D 1/04 122/7 R |
| 2010/0122793 | A1 | 5/2010 | Wolfe, IV et al. | |
| 2011/0239696 | A1 | 10/2011 | Takagi | |
| 2013/0086938 | A1 | 4/2013 | Higashiyama et al. | |
| 2013/0180696 | A1* | 7/2013 | Magee | F16B 17/00 165/175 |
| 2017/0211894 | A1 | 7/2017 | Schwalm | |
| 2018/0163573 | A1 | 6/2018 | Dang et al. | |

* cited by examiner

SYSTEM TO AGGREGATE WORKING FLUID FOR HEAT RECOVERY STEAM GENERATORS

CROSS-REFERENCE TO RELATED APPLICATIONS

This application is a continuation in-part of currently pending U.S. patent application Ser. No. 15/830,525 filed on Dec. 4, 2017. The application identified above is incorporated herein by reference in its entirety for all that it contains in order to provide continuity of disclosure.

BACKGROUND

The disclosure relates to heat recovery steam generators and, more specifically, systems to aggregate a working fluid for high cycling heat recovery steam generator systems.

Heat recovery steam generator (HRSG) systems may include an output manifold for aggregating flow and routing the working fluid to a steam turbine and/or other process demand. An HRSG may be fluidically connected to a plurality of header lines for directing fluid flow of low pressure, high pressure, and superheated steam through the stages of the HRSG. The output manifold contains and directs the flow of high temperature, pressurized fluids, such as superheated steam, from the superheated steam lines among the header lines. Any given output manifold has its own defined flow capacities, wall thickness, materials, and link assemblies for controlling and enduring thermal stresses. However, thermal stress from high cycling systems may increase component wear and decrease the life of the output manifold and/or its components.

Some output manifolds include a single fluid delivery line receiving fluids from header lines which carry heated fluids. The single fluid delivery line is sized for the output capacity of the system and the needs of the downstream steam turbine or other process demand. The diameter, thickness, and material requirements of the single fluid delivery line may increase both initial and replacement costs of the output manifold and/or require that the entire manifold be replaced in the event of wear or failure.

SUMMARY

A first aspect of this disclosure provides a system for aggregating a working fluid, the system including: a fluid delivery line defining a fluid connection to at least one downstream process component; a plurality of collection lines each fluidically connected to a plurality of header lines by a respective set of header links; and a connecting junction fluidically connecting each of the plurality of collection lines to the fluid delivery line, the connecting junction including: at least one tee member oriented substantially perpendicularly with respect to the fluid delivery line, the at least one tee member connected to the fluid delivery line, and a plurality of branch fluid lines each fluidically coupling a respective one of the plurality of collection lines to the at least one tee member.

A second aspect of the disclosure provides a heat recovery steam generator (HRSG) system including: a heat recovery steam generator that generates heated fluids; a plurality of header lines configured to receive the heated fluids from the heat recovery steam generator; and a manifold system configured to provide the heated fluids to at least one downstream process component, the manifold system including: a fluid delivery line defining a fluid connection to the at least one downstream process component; a plurality of collection lines each fluidically connected to the plurality of header lines by a respective set of header links; and a connecting junction fluidically connecting each of the plurality of collection lines to the fluid delivery line, the connecting junction including: at least one tee member oriented substantially perpendicularly with respect to the fluid delivery line, the at least one tee member connected to the fluid delivery line, and a plurality of branch fluid lines each fluidically coupling a respective one of the plurality of collection lines to the at least one tee member.

A third aspect of the disclosure provides a connecting junction for a manifold system, the connecting junction including: a base portion configured to engage a fluid delivery line of a heat recovery steam generator system; and a plurality of tee members each fluidically coupled to the base portion at a respective location, wherein each tee member is connected to a plurality of branch fluid lines, each fluidically coupling a respective one of a plurality of collection lines to a selected one of the plurality of tee members; wherein the plurality of branch fluid lines includes: a first branch fluid path coupled to a first collection line of the plurality of collection lines and coupled to the selected one of the plurality of tee members through a first outlet; and a second branch fluid path coupled to a second collection line of the plurality of collection lines and coupled to the selected one of the plurality of tee members through a second outlet diametrically opposed to the first outlet around a circumference of the selected one of the plurality of tee members.

The illustrative aspects of the present disclosure are arranged to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
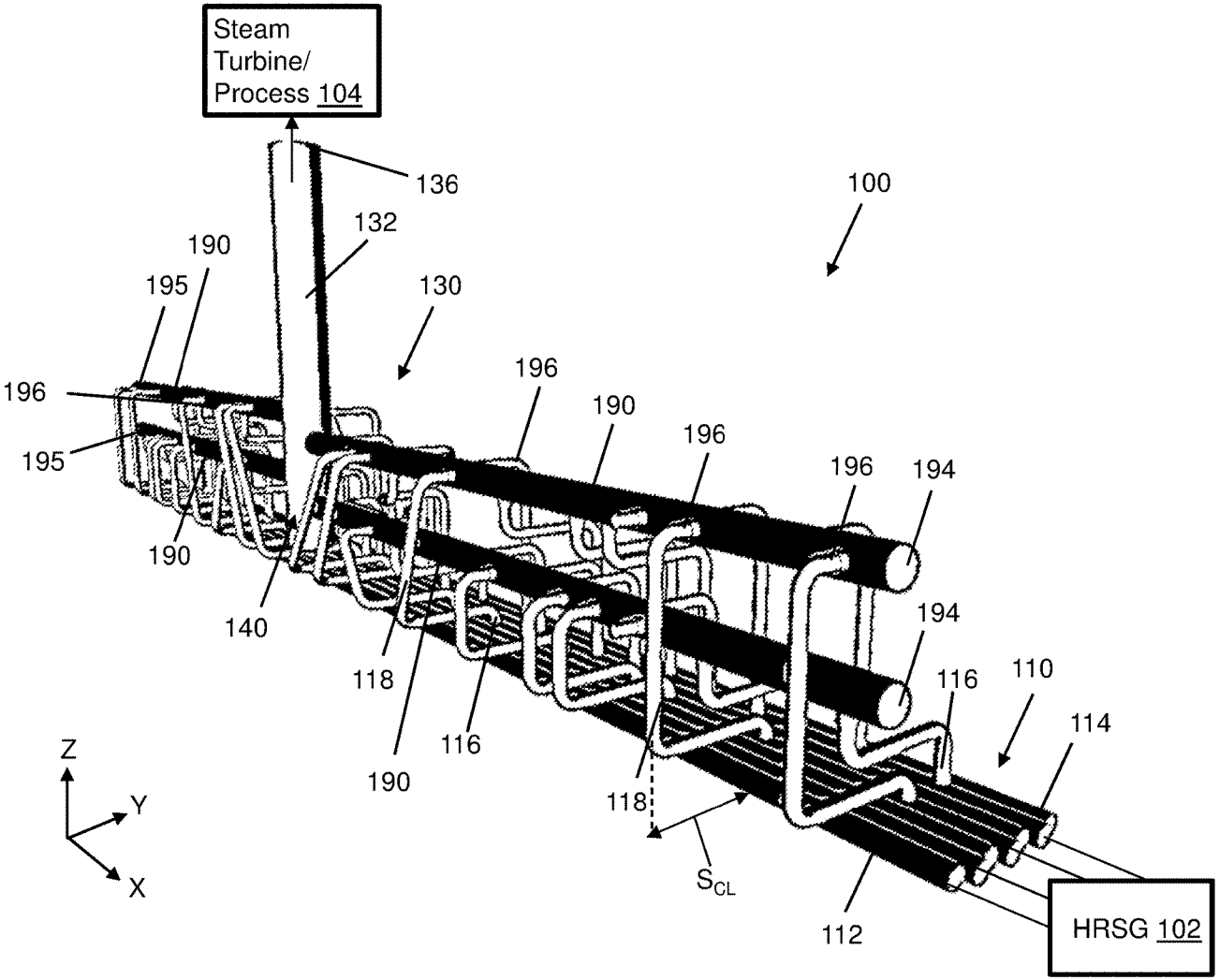
FIG. 1 shows a perspective view of a system for aggregating a working fluid according to various embodiments of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION

In the following description, reference is made to the accompanying drawings that form a part thereof and in which are shown, by way of illustration, specific illustrative embodiments in which the present teachings may be practiced. These embodiments are described in sufficient detail to enable those skilled in the art to practice the present teachings, and it is to be understood that other embodiments may be used and that changes may be made without departing from the scope of the present teachings. The following description is, therefore, merely illustrative.

Where an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Figure 2:
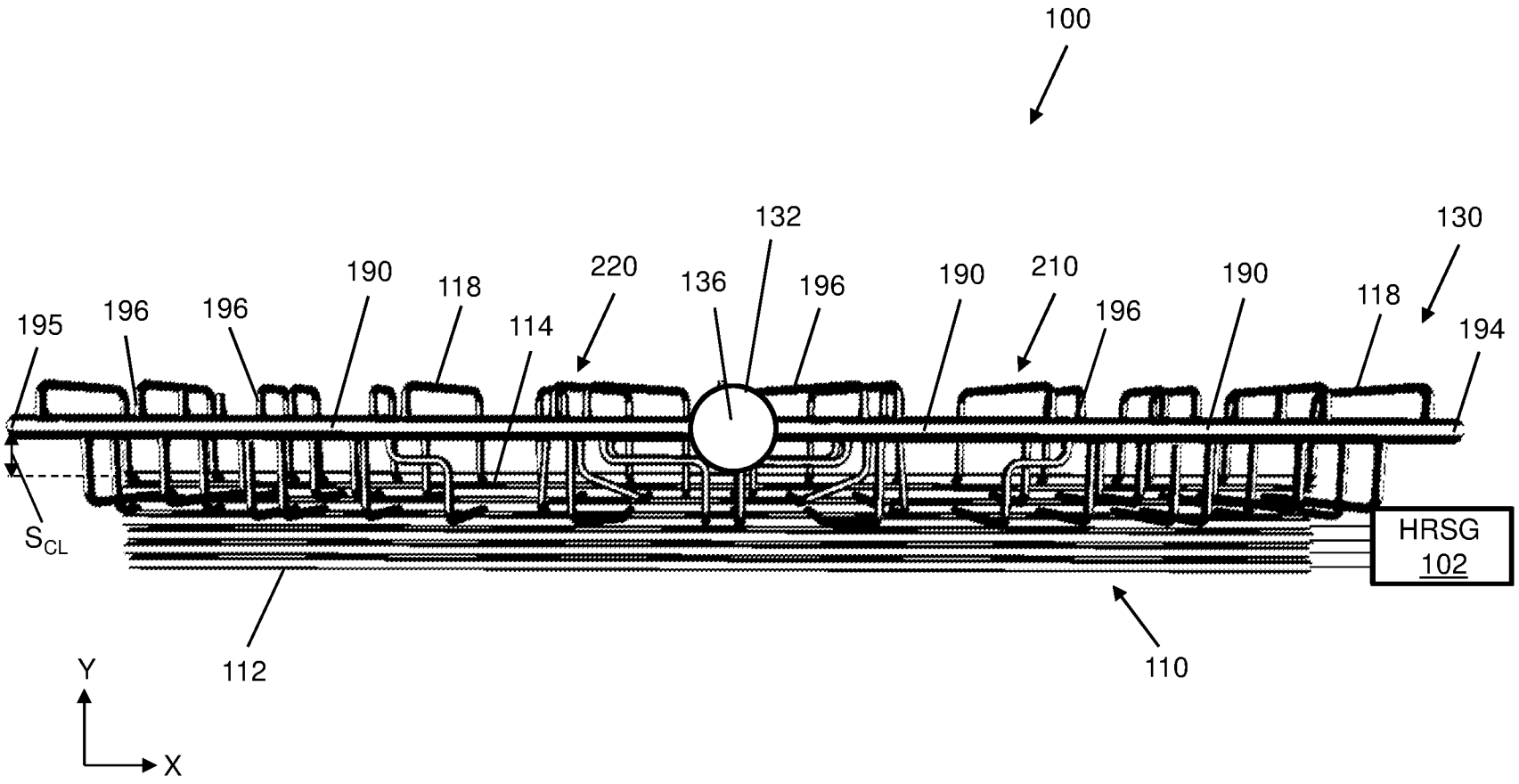
FIG. 2 shows a top-down view in plane X-Y of a system for aggregating a working fluid according to various embodiments of the disclosure.

Referring to FIGS. 1 and 2 together, a manifold system (simply "system" hereafter) 100 for aggregating a working fluid is shown. System 100 is shown as being coupled to a heat recovery steam generator (HRSG) 102, a steam turbine/process component 104, and a set of header lines 110. HRSG 102 may include an energy recovery heat exchanger for extracting heat from a hot gas stream. In some embodiments, HRSG 102 produces heated fluids, such as high-pressure superheated steam, for use by steam turbine/process component 104 (FIG. 1 only). Steam turbine/process component 104 may include a variety of downstream systems for using the heated fluids, such as powering a steam turbine or another steam-driven process. HRSG 102 may output fluid vertically or horizontally and may operate in a single pressure, multi-pressure, and/or other configuration to generate and direct heated fluids into header lines 110.

Header lines 110 may include a plurality of headers for directing fluid flow into HRSG 102 and/or receiving fluid flow out of HRSG 102. For example, header lines 110 may include a plurality of inlet header lines 112 and a plurality of output header lines 114. Header lines 110 may include any number of lines, including pipes or other fluid channels, arranged in parallel rows. For example, output header lines 114 may include seven individual header lines. HRSG 102 may generate heated fluids, which enter output header lines 114. System 100 allows the heated fluids to be collected and delivered to steam turbine/process component 104. Output header lines 114 may include a number of header links 116 for attaching to collection lines 118. Header links 116 may provide fluidically connectable inlets from output header lines 114 for directing fluids into other portions of system 100. Collection lines 118 may attach to output header lines 114 to fluidically connect header lines 110 to other portions of system 100. In some embodiments, header links 116 may be grouped into sets based on their location and/or the destination of collected fluids. For example, header links 116 may be grouped in sets of three to support a configuration of similar connecting lines and/or junctions which lead to steam turbine/process component 104. In some embodiments, header links 116 may include outlet fittings such as a nozzle, pipe connector, or other component, for attaching collection lines 118 to header links 116.

Collection lines 118 may include various configurations of pipes or other fluid channels that extend away from header lines 110 to fluidically connect them and traverse the distance from header lines 110 to other components of system 100. In such an arrangement, collection lines 118 may extend substantially in parallel with each other, e.g., substantially in the direction of the Y-axis, as shown in FIG. 1. The size of collection lines 118 and the distance traversed may be determined, e.g., by the physical arrangement of heat recovery steam generator system 100 within a given site. Note that some collection lines 118 or portions thereof may be omitted from the view shown in FIG. 1 to improve visibility of other structures but would nonetheless be present in the example configuration shown.

A connecting junction 130 may receive heated fluids from the plurality of collection lines 118 and consolidate the fluid flow into one or more combined fluid paths leading to steam turbine/process component 104. Connecting junction 130 may include a fluid delivery line 132 defining an output path fluidically connected to at least one downstream process or component, such as steam turbine/process component 104. Fluids flowing into fluid delivery line 132 may be directed out of connecting junction 130 through manifold outlet 136, which may connect to further equipment or lines to fluidically connect with steam turbine/process component 104. Fluid delivery line 132 may have a fluid delivery line length measured, e.g., from manifold outlet 136 to a base portion 140 of fluid delivery line 132. Base portion 140 may be structurally integrated with fluid delivery line 132 or may be a separate coupling component in fluid communication with an end of fluid delivery line 132 opposite manifold outlet 136.

Connecting junction 130 may include one or more tee members 190 fluidically connected to header lines 110 for receiving heated fluids from HRSG 102 and directing those heated fluids to fluid delivery line 132. Tee member(s) 190 may be fluidically coupled to base portion 140 of fluid delivery line 132. Each tee member 190 may extend outward from fluid delivery line 132 in a direction that is substantially perpendicular to the orientation of fluid delivery line 132. In an example where fluid delivery line 132 extends vertically, e.g., in the direction of the Z-axis, each tee member 190 may extend perpendicularly outward from fluid delivery line 132 substantially in parallel with the X-axis. In some embodiments, connecting junction 130 may include four or more tee members 190 in a configuration where two or more tee members 190 extend outward from fluid delivery line 132 and/or base portion 140, in parallel with each other in a first direction (e.g., in the positive X direction as shown). Two or more other tee members 190 extend outward from fluid delivery line in parallel with each other in a second, opposite direction (e.g., in the negative X direction as shown). Tee members 190 may be in a spaced parallel configuration and may have a respective length, which may be substantially the same as or distinct from other tee members 190 of connecting junction 130. Fluid delivery line 132 may have a length that is significantly less than a corresponding length of each collection line 118 and tee member 190 but may have a greater cross-sectional diameter to accommodate fluids transmitted to fluid delivery line 132 by multiple collection lines 118 and tee members 190.

Tee member(s) 190 may be separated from header lines 110 by a collection line spacing $S_{CL}$ in any desired orientation, e.g., substantially in parallel with the Y-axis as shown in FIG. 1. Connecting junction 130 thus may span the length of collection line spacing $S_{CL}$, and in further embodiments may include one or more elements (e.g., collection lines 118) positioned horizontally beyond the location of fluid delivery line 132. The length of each tee member 190 may be defined as the distance between its connection to fluid delivery line 132 and a distal end 194, 195 of tee member 190. In some embodiments, distal ends 194, 195 are sealed and do not provide an outlet for fluids within tee member(s) 190. In other cases, distal ends 194, 195 may connect to one or more collection lines 118 and/or other fluid delivery lines (not shown) outside system 100 and/or connecting junction 130.

Figure 3:
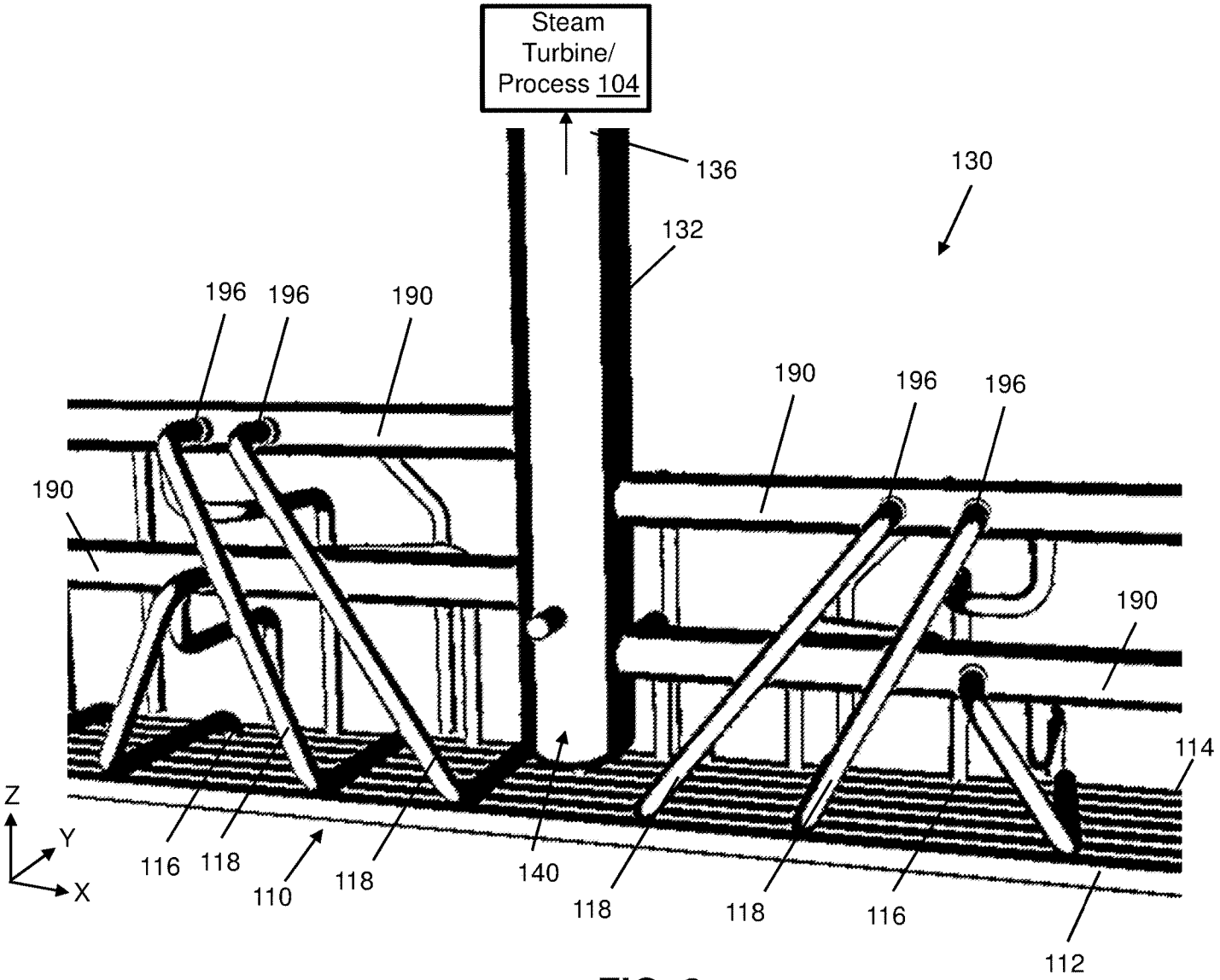
FIG. 3 shows an expanded partial perspective view of a system for aggregating a working fluid, and tee members therein, according to various embodiments of the disclosure.
Figure 4:
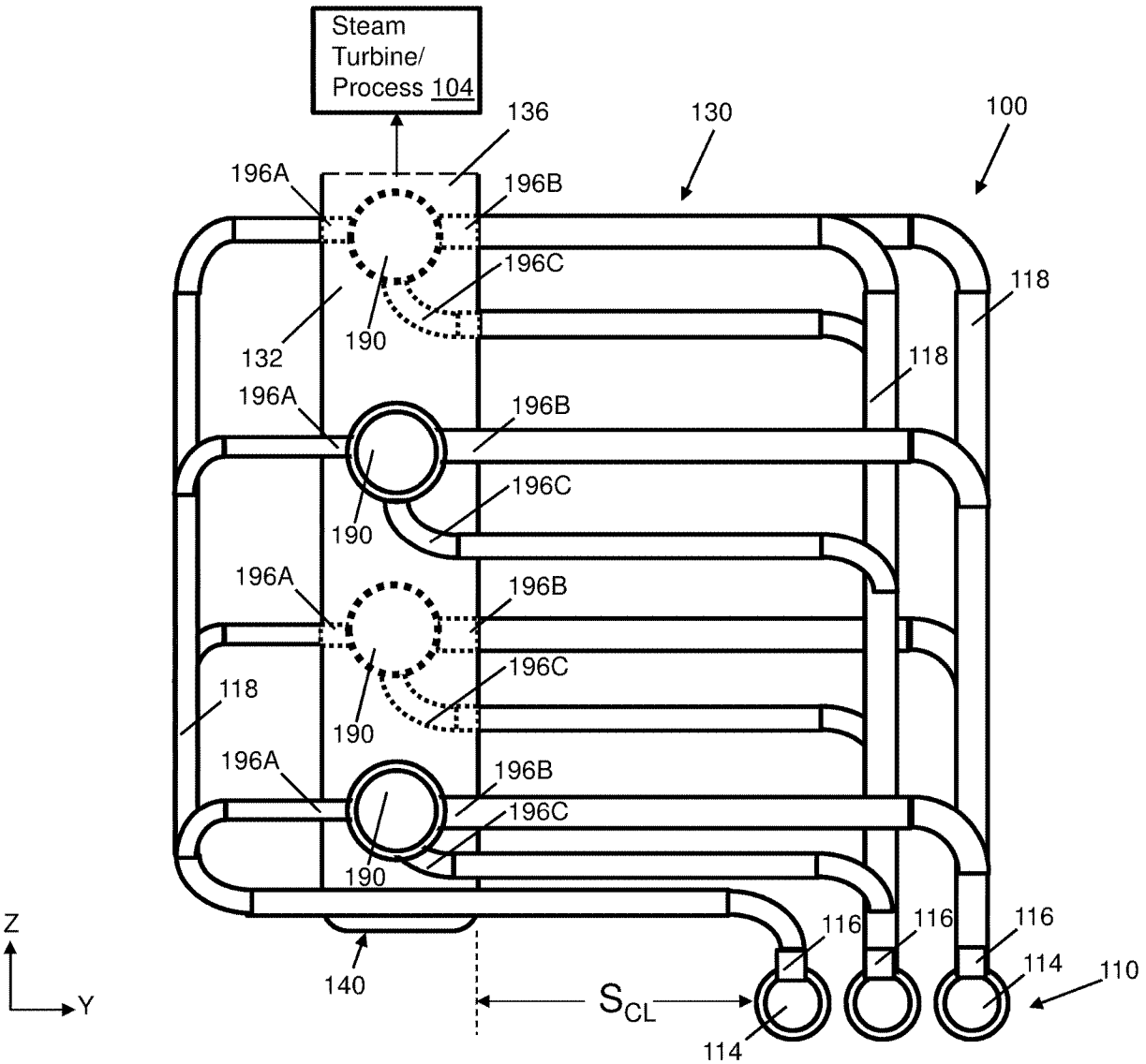
FIG. 4 shows a cross-sectional view in plane Y-Z of a connecting junction and system for aggregating a working fluid according to various embodiments of the disclosure.

Referring to FIGS. 3 and 4, tee member(s) 190 may receive heated fluids from header lines 110 through the plurality of collection lines 118 via a corresponding plurality of branch fluid lines 196. In some embodiments, branch fluid lines 196 may be connected to the same header lines 110 through one or more outlet fittings along the length of each of header lines 110. In further examples, each set of branch fluid lines 196 may be fluidically coupled to a corresponding one of the plurality of collection lines 118. Header lines 110 may support sixty or more collection lines 118, which may be subdivided into a first set of thirty or more collection lines 118 for tee members 190 on one side of fluid delivery line 132 and a second set of thirty or more collection lines 118 for tee members 190 on another side of fluid delivery line 132.

Each set of connecting lines 118 in turn may be configured in a variety of groupings or patterns along the length of header lines 110 and/or tee member(s) 190, generally including alternating patterns of one or more connecting lines 118 connecting to a corresponding number of branch fluid lines 196. The specific tee member(s) 190 to which each connecting line 118 may connect alternate by any desired arrangement, e.g., by alternately connecting to each of the various tee members 190 at successive locations along the length of header lines 110. The sequence may repeat periodically across the length of header lines 110 and/or may vary based on the size and/or volumes of fluid within header lines 110. In some embodiments, alternating subsets of collection lines 118 may each include four lines, each of which may connect to a respective tee member 190.

In some embodiments, branch fluid lines 196 may be positioned at a midpoint of tee member 190 lengths such that tee member(s) 190 connect branch fluid lines 196 to fluid delivery line 132. For example, the length of fluid delivery line 132 may be up to approximately half of the length of tee member(s) 190. Here, portions of fluid delivery line 132 positioned opposite manifold outlet 136 connect with connecting tee member(s) 190 at approximately the midpoint of a corresponding portion of header lines 110. In some embodiments, substantially all fluids passing through collection lines 118 exit through branch fluid line(s) 196 into tee member(s) 190 before proceeding to fluid delivery line 132 and subsequently to steam turbine/process component 104.

Referring to FIG. 4, connecting tee member 190 is shown interconnecting several collection lines 118 to fluid delivery line 132. In some embodiments, collection lines 118 may pass through or otherwise be attached to multiple branch fluid line(s) 196 (separately identified as branch fluid lines 196A, 196B, 196C in FIG. 4), which define outlets from collection line(s) 118 to tee member(s) 190. Each header link 196 may include or otherwise define a respective outlet for fluidically connecting one or more collection lines 118 to tee member 190. In an example, each collection line 118 may connect to a selected tee member 190 via a corresponding branch fluid line 196A, 196B, 196C. Although groupings of three branch fluid lines 196A, 196B, 196C are shown for each tee member 190 in FIG. 4, it is understood that more or fewer branch fluid lines 196 may be used in further embodiments.

In some embodiments, each tee member 190 may include several branch fluid lines 196A, 196B, 196C to provide a fluid connection to header lines 110 through collection lines 118. In this case, each branch fluid line 196A, 196B, 196C may define first, second, and third branch fluid paths respectively. In some embodiments, each branch fluid line 196A, 196B, 196C may be parallel and/or axially aligned with a corresponding portion of another branch fluid line 196A, 196B, 196C to define opposing flow directions into tee member 190. In some embodiments, one or more branch fluid lines 196A, 196B, 196C may be perpendicular to the orientation of tee member 190. In yet another example, branch fluid lines 196A, 196B, 196C, collection lines 118, and tee members 190 may form connecting junction 130 as a continuous component that is attached to and fluidly coupled between fluid delivery line 132 and header lines 110.

In some embodiments, branch fluid lines 196A, 196B, 196C may be spaced substantially evenly around the circumference of tee member(s) 190. In one example, two branch fluid lines 196A, 196B may be diametrically opposed to each other around a base circumference of a respective tee member 190. In a further example, a set of three of branch fluid lines 196A, 196B, 196C may define respective outlets into tee member 190 such that two branch fluid lines 196A, 196B are diametrically opposed to each other while another branch fluid line 196C is positioned circumferentially between branch fluid liens 196A, 196B, e.g., at a circumferential midpoint therebetween. In cases where more or fewer branch fluid lines 196 are included, the circumferential spacing between adjacent branch fluid lines 196 may be adjusted to create a uniform or non-uniform distribution of branch fluid lines 196 at their coupling to tee member 190.

In some embodiments, the flow capacity of collection lines 118 may be less than the flow capacity of fluid delivery line 132. For example, fluid delivery line 132 may be sized to include a diameter that is larger than each collection line 118 as well as a diameter of each tee member 190. In some embodiments, the output diameter of fluid delivery line 132 may be at least twice the diameter of each collection line 118 and/or at least twice the diameter of each tee member 190. In some embodiments, the ratio of the cross-sectional area of the diameter of each collection line 118, and/or that of tee member(s) 190, to the diameter of fluid delivery line 132 may be in the range of 1:2 to 1:4.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A system for aggregating a working fluid, the system comprising:

a fluid delivery line defining a fluid connection to at least one downstream process component;

a plurality of collection lines each fluidically connected to a plurality of header lines by a respective set of header links; and a connecting junction fluidically connecting each of the plurality of collection lines to the fluid delivery line, the connecting junction including:

at least one tee member oriented substantially perpendicularly with respect to the fluid delivery line, the at least one tee member connected to the fluid delivery line, and a plurality of branch fluid lines each fluidically coupling a respective one of the plurality of collection lines to the at least one tee member, the plurality of branch fluid lines including:

a first branch fluid path coupled to a first collection line of the plurality of collection lines and coupled to a first tee member of the at least one tee member through a first outlet;

a second branch fluid path coupled to a second collection line of the plurality of collection lines and coupled to the first tee member through a second outlet diametrically opposed to the first outlet around a circumference of the first tee member; and a third branch fluid path coupled to a third collection line of the plurality of collection lines and coupled to the first tee member through a third outlet circumferentially between the first and second outlets around the circumference of the first tee member.

2. The system of claim 1, wherein the at least one tee member includes a plurality of tee members, and wherein the plurality of branch fluid lines fluidically couples each of the plurality of header lines to each of the plurality of tee members.

3. The system of claim 1, wherein each of the plurality of collection lines has a collection line length from a collection line first end to a collection line second end, and a plurality of branch inlets distributed equidistantly across the collection line length between the collection line first end and the collection line second end, and wherein the plurality of branch fluid lines couples one of the plurality of branch inlets to the at least one of tee member.

4. The system of claim 1, wherein the plurality of collection lines is horizontally parallel to each other.

5. The system of claim 1, wherein one of the plurality of collection lines is separated from the fluid delivery line by a collection line spacing, and the connecting junction spans the collection line spacing.

6. The system of claim 1, wherein the fluid delivery line has a fluid delivery line length, each of the plurality of collection lines has a respective collection line length, and the fluid delivery line length is less than the collection line length of each of the plurality of collection lines.

7. The system of claim 1, wherein the fluid delivery line has a fluid delivery line diameter, each of the plurality of collection lines has a respective collection line diameter, and the fluid delivery line diameter is at least twice the collection line diameter of each of the plurality of collection lines.

8. The system of claim 1, wherein each set of header links comprises a portion of a heat recovery steam generator system.

9. A heat recovery steam generator (HRSG) system comprising:

a heat recovery steam generator that generates heated fluids;

a plurality of header lines configured to receive the heated fluids from the heat recovery steam generator; and a manifold system configured to provide the heated fluids to at least one downstream process component, the manifold system including:

a fluid delivery line defining a fluid connection to the at least one downstream process component;

a plurality of collection lines each fluidically connected to the plurality of header lines by a respective set of header links, wherein each of the plurality of collection lines extends parallel with each other; and a connecting junction fluidically connecting each of the plurality of collection lines to the fluid delivery line, the connecting junction including:

at least one tee member oriented substantially perpendicularly with respect to the fluid delivery line, the at least one tee member connected to the fluid delivery line, and a plurality of branch fluid lines each fluidically coupling a respective one of the plurality of collection lines to the at least one tee member.

10. The HRSG system of claim 9, wherein the at least one tee member includes a plurality of tee members, and wherein the plurality of branch fluid lines fluidically couples each of the plurality of header lines to each of the plurality of tee members.

11. The HRSG system of claim 9, wherein the plurality of branch fluid lines includes:

a first branch fluid path coupled to a first collection line of the plurality of collection lines and coupled to a first tee member of the at least one tee member through a first outlet; and a second branch fluid path coupled to a second collection line of the plurality of collection lines and coupled to the first tee member through a second outlet diametrically opposed to the first outlet around a circumference of the first tee member.

12. The HRSG system of claim 11, wherein the plurality of branch fluid lines further includes:

a third branch fluid path coupled to a third collection line of the plurality of collection lines and coupled to the first tee member through a third outlet circumferentially between the first and second outlets around the circumference of the first tee member.

13. The HRSG system of claim 10, wherein each of the plurality of collection lines has a collection line length from a collection line first end to a collection line second end, and a plurality of branch inlets distributed equidistantly across the collection line length between the collection line first end and the collection line second end, and wherein the plurality of branch fluid lines couples one of the plurality of branch inlets to a respective one of the plurality of tee members.

14. The HRSG system of claim 9, wherein one of the plurality of collection lines is separated from the fluid delivery line by a collection line spacing, and the connecting junction spans the collection line spacing.

15. The HRSG system of claim 9, wherein the fluid delivery line is parallel to the plurality of collection lines, the fluid delivery line has a fluid delivery line length, each of the plurality of collection lines has a respective collection line length, and the fluid delivery line length is less than the collection line length of each of the plurality of collection lines.

16. The HRSG system of claim 9, wherein the fluid delivery line has a fluid delivery line diameter, each of the plurality of collection lines has a respective collection line diameter, and the fluid delivery line diameter is at least twice the collection line diameter of one of the plurality of collection lines.

17. A connecting junction for a manifold system, the connecting junction comprising:

a base portion configured to engage a fluid delivery line of a heat recovery steam generator system; and a plurality of tee members each fluidically coupled to the base portion at a respective location, wherein each of the plurality of tee members is connected to a plurality of branch fluid lines, each fluidically coupling a respective one of a plurality of collection lines to a selected one of the plurality of tee members;

wherein the plurality of branch fluid lines includes:

a first branch fluid path coupled to a first collection line of the plurality of collection lines and coupled to the selected one of the plurality of tee members through a first outlet; and a second branch fluid path coupled to a second collection line of the plurality of collection lines and coupled to the selected one of the plurality of tee members through a second outlet diametrically opposed to the first outlet around a circumference of the selected one of the plurality of tee members.

* * * * *